US005550618A

United States Patent [19]

Herbert et al.

[11] Patent Number: 5,550,618

[45] Date of Patent: Aug. 27, 1996

[54] DRUM IMAGING STRUCTURE WITH PHOTOSENSITIVE MEMBER

[75] Inventors: William G. Herbert, Williamson; Satchidanand Mishra, Webster; Richard L. Post, Penfield; Donald C. VonHoene, Fairport; Robert C. U. Yu, Webster; Geoffrey M. T. Foley, Fairport; William W. Limburg, Penfield, all of N.Y.

[73] Assignee: Xerox Corporation, Stamford, Conn.

[21] Appl. No.: 63,177

[22] Filed: May 18, 1993

[51] Int. Cl.[6] ..... G03G 5/00

[52] U.S. Cl. ..... 355/211; 355/212; 430/58; 430/69

[58] Field of Search ..... 355/210, 211, 355/212, 213; 430/58, 84, 96, 902, 62, 31, 69

[56] References Cited

U.S. PATENT DOCUMENTS

| | | | |
|---|---|---|---|
| 3,695,757 | 10/1972 | Gregory | 355/211 X |
| 3,730,623 | 5/1973 | Jordan | 355/212 |
| 3,972,715 | 8/1976 | Okumura | 430/31 X |
| 4,068,942 | 1/1978 | Penwell . | |
| 4,400,083 | 8/1983 | Beisty et al. . | |
| 4,707,712 | 11/1987 | Buckley et al. . | |
| 5,034,295 | 7/1991 | Allen et al. | 430/58 |
| 5,091,278 | 2/1992 | Teuscher et al. . | |
| 5,151,737 | 9/1992 | Johnson et al. | 355/211 |
| 5,164,276 | 11/1992 | Robinson et al. . | |
| 5,173,733 | 12/1992 | Green | 355/212 X |
| 5,210,574 | 5/1993 | Kita | 355/211 |
| 5,386,273 | 1/1995 | Wood et al. | 355/212 |
| 5,415,961 | 5/1995 | Yu et al. | 355/213 X |

*Primary Examiner*—Arthur T. Grimley
*Assistant Examiner*—Shuk Y. Lee
*Attorney, Agent, or Firm*—Oliff & Berridge

[57] ABSTRACT

An electrostatographic imaging structure is provided having at least one distinct outer layer including a rotary drum having an outer peripheral surface, a retainer either separate from or a part of the drum or a hold down mechanism, and a photosensitive member held down to the peripheral surface of the drum by the retainer or hold down mechanism.

49 Claims, 4 Drawing Sheets

DRUM IMAGING STRUCTURE WITH PHOTOSENSITIVE MEMBER

BACKGROUND OF THE INVENTION

This invention relates in general to electrostatography and in particular, to an improved electrostatic imaging structure.

In electrostatography, an electrophotographic imaging member, such as a plate, drum, belt or the like, containing a photoconductive insulating layer on a conductive layer, is imaged by first uniformly electrostatically charging its surface. The photosensitive imaging member is then exposed to a pattern of activating electromagnetic radiation such as light. The radiation selectively dissipates the charge in the illuminated areas of the photoconductive insulating layer while leaving behind an electrostatic latent image in the non-illuminated areas. The electrostatic latent image is then developed to form a visible image by depositing finely divided electroscopic marking particles on the surface of the photoconductive insulating layer. The resulting visible image is transferred from the imaging member directly or indirectly to a support such as paper. This imaging process can be repeated many times with reusable imaging members.

The photosensitive member is provided in a variety of forms. Typical imaging members include, for example, photoreceptors for electrophotographic imaging systems, and electroreceptors or ionographic imaging members for electrographic imaging systems. Both electrophotographic and ionographic imaging members are commonly used in either belt-form or drum-form. Electrostatographic imaging member belts are seamless or seamed. The belts generally comprise a flexible supporting substrate coated with one or more layers of photoconductive material. The substrates are inorganic, such as electroformed nickel, or organic, such as a film-forming polymer. The photoconductive coatings applied to these belts are inorganic or organic. Inorganic coatings include selenium and selenium alloys. The organic photoconductive layers comprise, for example, single binder layers in which photoconductive particles are dispersed in a film-forming binder or multi-layers comprising, for example, a charge generating layer and a charge transport layer.

Electrophotographic imaging members having a belt configuration are normally entrained around and supported by at least two rollers. Generally, one of the rollers is driven by a motor to rotate the belt during electrophotographic imaging cycles. Electrophotographic imaging belts, particularly welded seam belts, are not perfectly cylindrical, tending to be slightly cone shaped. These flexible belts tend to "walk" axially along the support rollers. Belt walking causes one edge of the belt to strike one or more edge guides positioned adjacent the ends of the rollers to limit axial movement. Friction between the edge guide and the edge of the photoreceptor belt can cause wear, rip, buckle and other damage to the belt.

Belts driven around supporting rollers often slip during stop and go operations. Belt slipping becomes a serious problem when the surface contact friction between the backside of the imaging belt and the elastomeric outer surface of the drive roll is reduced as a result of aging or deposition and accumulation of undesirable foreign material on the surface of the drive roll. This slippage adversely affects registration of images, particularly where multiple, sequentially formed and transferred images must precisely register with each other in applications such as color imaging. Further, sophisticated detection systems are required with seamed belts to ensure that images are not formed on the seam. Welded belts, because of the difficulties associated with perfectly aligning overlapping ends during seam welding, are not as concentric as desired.

Supporting rollers for an electrophotographic imaging belt generally have relatively small diameters. Constant flexing of the belt around small diameter support rollers causes the seam to crack. The cracks propagate and cause belt delamination. In addition to seam cracking and delamination, dynamic flexing of the belt around the small diameter support rollers also causes cracking of the outer imaging layer. Cracking of the outer imaging layer leads to copy print defects. Further, the supporting rollers vibrate and undesirably alter the critical distances between the imaging surface of the belt and devices such as optical exposure means, charging corotrons, development applicators, transfer stations and the like.

During cyclic electrostatographic imaging processes, the anti-curl backing coating on a belt tends to wear due to frictional interaction against support rollers, the drive roller and the various skid plate backing systems. Such wear reduces the effectiveness of the anti-curl backing coating in preventing curling of edges of the belt. Moreover, as the anti-curl back coating wears, it generates dirt, debris, and other particulates. In this respect, anti-curl back coating wear adversely affects the belt operation and contaminates the image copy print-out.

Another well-known type of electrophotographic imaging member is the drum-type photoreceptor. The long term durability of drum-type photoreceptors greatly exceeds that of belt-type photoreceptors. Drum photoreceptors are coated with one or more coatings. The coatings are applied by well known techniques such as dip coating or spray coating. Dip coating of drums usually involves immersing the cylindrical drum. During the coating and subsequent drying operation, the axis of the drum is maintained in a vertical alignment. The applied coatings tend to run and, as a result, the coatings on the drum tend to be thicker at the lower end.

Coatings applied by spray coating are often uneven. Coatings having an uneven thickness do not have uniform electrical properties, thereby degrading the print quality. Coating drums in a spray batch operation is time consuming and costly. In addition, the numerous handling steps required for batch drum coating tend to increase the likelihood that one or more coatings will be damaged or contaminated. Dip or spray coated photoreceptor drums do not exhibit the superior electrophotographic characteristics of flexible electrostatographic imaging belts. Moreover during reclaiming, the coatings are difficult to remove without damaging the drum.

U.S. Pat. No. 4,068,942 (to Penwell) teaches a hollow drum and an elongated web of photosensitive material. The bulk of the material is supported inside the hollow drum while a portion of the photosensitive material is supported on the outer surface of the drum. The photosensitive web within the drum is supported by a supply roll and a take-up roll. The rolls are capable of being repositioned periodically in order to provide for the accumulation of a greater length of photosensitive web.

U.S. Pat. No. 4,400,083 (to Beisty et al.) discloses an electrostatic printer with a rotatable drum having a photoreceptor belt mounted on the drum periphery. A supply reel and a take-up reel are located in the drum interior. The drum includes a wiper mechanism for wiping the face of a cathode ray tube as the drum is rotated. The wiper includes a mechanism for periodically indexing a supply of photoreceptor web from the supply reel.

U.S. Pat. No. 4,707,712 (to Buckley et al.) teaches a method and apparatus for transporting and tensioning sheet materials in an ink jet printer. A roll of paper is stored within an imaging drum. The paper feeds through a longitudinal opening in the drum to the outside and passes around the drum, where it is held in place during the imaging process. The paper is held in place by tension provided by reverse rotation of a tensioning roller while a drive roller is locked in position.

U.S. Pat. No. 5,151,737 (to Johnson et al.) discloses a photoconductive drum with a flexible photoconductive loop and an expandable mount. The mount includes a shell with a slit allowing the shell to expand. Wedges are moved toward each other on a shaft. Cam surfaces on the wedges push against chamfered corners on ribs extending inward from the shell to expand both ends of the shell. The shell assumes the shape of the loop.

U.S. Pat. No. 5,415,961 to Yu et al., filed Sep. 29, 1992, discloses a cylindrical device comprising at least one distinct outer layer. The cylindrical device is a preformed rigid cylindrical support drum with a predetermined outer circumference. A flexible belt, with an inner circumference at least 0.5% smaller than the outer circumference of the support drum, is mounted to the drum by a process of circumferentially expanding the belt with fluid under pressure until the circumference of the inner surface of the belt is stretched to a new dimension slightly greater than the outer circumference of the support drum. The belt is then slid onto the support drum and permitted to contract to the drum outer surface by release of the fluid pressure from the supply source.

SUMMARY OF THE INVENTION

The invention provides an electrostatographic imaging member which combines the high-quality imaging capability of belt-type photoreceptors with the long-term durability of drum-type photoreceptors. The invention specifically provides for a variety of mechanisms for securely mounting the belt-type photoreceptor to the drum, including mechanical, chemical, vacuum, magnetic and electrostatic, and combinations of these.

The electrostatographic imaging structure has at least one distinctive outer layer. The electrostatographic imaging structure may be an electrophotographic imaging structure comprising a rotary drum having an outer peripheral surface, a retainer either separate from or a part of the drum and a photosensitive member held down tightly to the peripheral surface of the drum by the retainer.

BRIEF DESCRIPTION OF THE DRAWINGS

FIG. 3 shows a mechanical retainer;

FIG. 4 shows a magnetic retainer;

FIGS. 5 shows a vacuum retainer with pump located within the drum;

FIG. 6 shows a vacuum retainer with pump located outside the drum;

FIG. 7 shows an electrostatic charging by poling of the drum;

DESCRIPTION OF PREFERRED EMBODIMENTS

Figure 1:
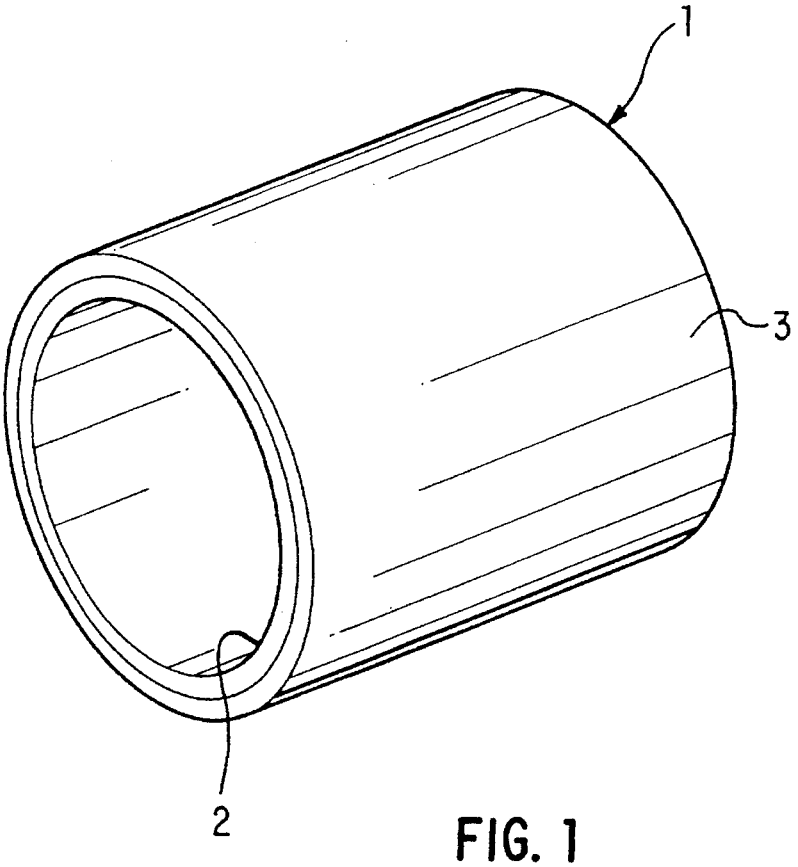
FIG. 1 is a schematic representation of an electrophotographic imaging structure of the invention.

In a first preferred embodiment, the retainer generates sufficient frictional contacting force to prevent the photosensitive member from slipping during imaging function. The photosensitive member is held down to the surface of the drum by the retainer at a single spot location on the outer peripheral surface of the drum. The retainer is a mechanical structure capturing the ends of the photosensitive member. The retainer may comprise a portion of the shell having opposing ends and a slit between the ends to permit expansion of the shell. The photosensitive member is held down by mechanically capturing at least one end of the member within the slit of the retainer. The drum comprises an adjustable, external circumference and an adjuster for changing the circumference. The adjustor is driven by hydraulic or pneumatic pressure. If necessary, the retainer further comprises an adhesive applied between the drum and the photosensitive member to further hold the member to the surface of the drum. In another embodiment, the retainer comprises only an adhesive applied between the drum and the photosensitive member to hold the member to the surface of the drum.

In another embodiment, the retainer comprises a magnetic hold down mechanism between the drum and a magnetic photosensitive member. The magnetic hold mechanism can also be combined with one or more hold down structures, such as the above-described mechanical hold down structure, or an adhesive. If the member is non-magnetic, the magnetic hold down mechanism preferably comprises magnetic strips applied to the drum and the photosensitive member.

In a further preferred embodiment, the hold down mechanism comprises a vacuum device. In this embodiment, the drum has apertures through the drum outer peripheral surface between the drum and the photosensitive member. The apertures comprise an array of perforations evenly or unevenly distributed over the drum outer peripheral surface. The perforations have a diameter between 0.001 to 0.1 mils and preferably 0.02 to 0.05 mils. The density of the perforations over the drum outer surface is preferably between 0.003 square inch/square inch to 0.5 square inch/square inch. Preferably the density of perforations is stated as a percentage of the drum outer peripheral surface. The density is 0.3% to 50%, preferably 5% to 10% of the drum surface. The perforations in the drum outer peripheral surface may be fabricated by laser drilling. Alternately, the drum comprises nickel or nickel alloy and the perforations are fabricated into the drum outer peripheral surface by electroforming. Alternately, the apertures comprise a sintered porous surface formed as at least part of the peripheral surface of the drum, a microscopically porous surface which is formed as a part of the peripheral surface of the drum, or a fabric such as felt, nap, polypropylene, silk, canvas or the like. Additionally, the photosensitive member comprises a substrate with an array of ribs or slots oriented parallel to a longitudinal axis of the drum. The ribs or slots preferably extend across the width of the photosensitive member.

The vacuum hold down mechanism may comprise a vacuum pump external to the drum. In this embodiment, a channel is located between the pump and the interior of the drum. The interior of the drum is defined by a vacuum tight seal around the channel. In another embodiment, the vacuum hold down mechanism comprises a vacuum pump located within the interior of the drum. The vacuum pump may be a heat pump type compressor which is capable of generating vacuum through the rotational motion of the photoreceptor structure. In the embodiments using a vacuum hold down mechanism, the mechanism can be combined with other retainers or hold down mechanisms.

Additionally, the present invention provides a drum and photosensitive member structure that comprises an electrostatic hold down mechanism. The electrostatic hold down mechanism holds down the member to the peripheral surface of the drum. The electrostatic hold down mechanism can be combined with other retainers or hold down mechanisms. The electrostatic hold down mechanism can be provide by the rotary drum comprising an electrostatic charge insulative layer of a first polarity with the photosensitive member comprising an electrostatically insulated surface of opposite charge polarity. The photosensitive member additionally may comprise a ground.

In another embodiment, the electrostatic hold down mechanism is provided by the rotary drum comprising a ferromagnetic material. The photosensitive member can comprise a ferromagnetic material to provide at least a part of the magnetic hold down mechanism.

Further, the present invention provides an image forming process that utilizes a photoreceptor structure having at least one distinctive outer layer comprising a rotary drum having an outer peripheral surface, a vacuum hold down mechanism either separate from or a part of the drum and a photosensitive member held down to the peripheral surface of the drum by the vacuum hold down mechanism. The image forming process comprises (i) developing a vacuum by powering up the hold down mechanism to hold down the photosensitive member to the peripheral surface of the drum, (ii) conducting cycles of image formation comprising forming latent images on the photosensitive member, developing the images by means of a developer and transferring the images onto a transfer material, and (iii) maintaining a reduced vacuum by the hold down mechanism to hold down the photosensitive member after conducting the cycles of image formation.

Figure 3:
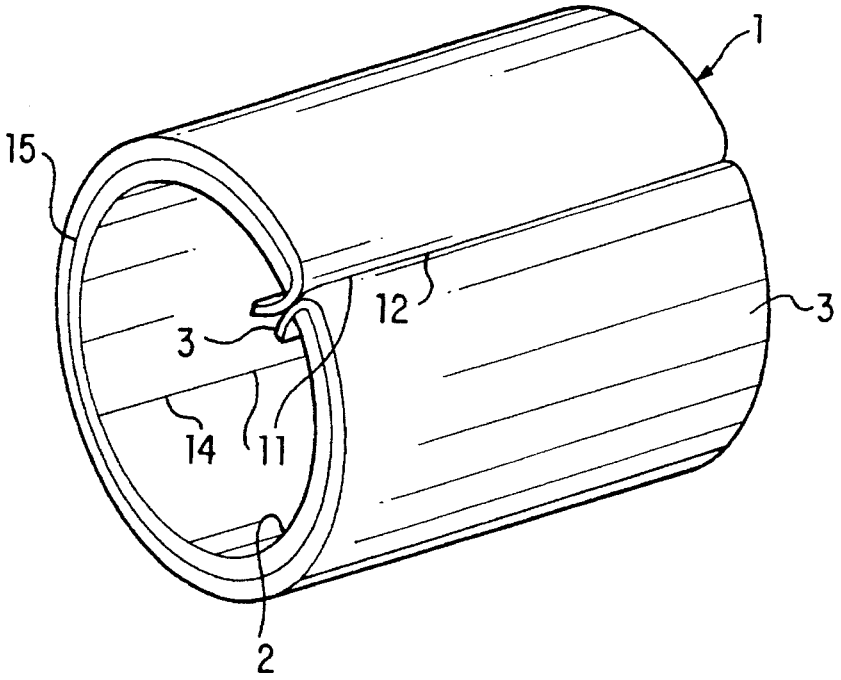
FIGS. 3–7 are schematic representations of embodiments of the electrophotographic imaging structure.
Figure 4:
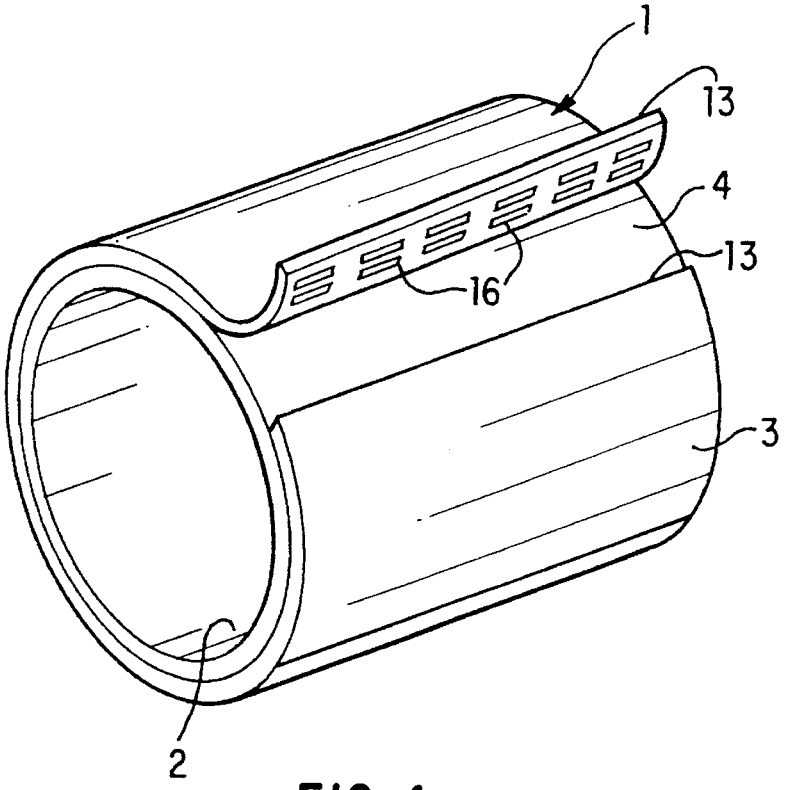
Figure 5:
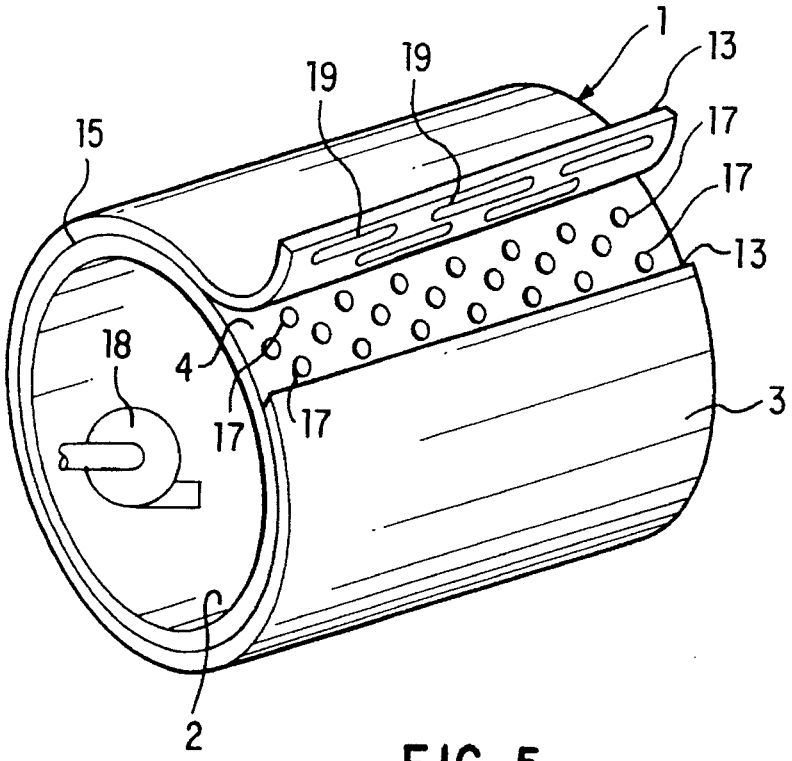

Referring to the drawings, FIGS. 1 and 3 to 6 show an electrophotographic imaging structure 1 comprising a rotary drum 2 and a photoreceptor member 3. FIGS. 4 and 5 show photosensitive member 3 partially peeled away from drum 2 to show outer peripheral surface 4.

In FIG. 1, the rotary drum 2 holds the photosensitive member 3 to the drum 2 by a retainer or hold-down mechanism. Drum 2 is preferably a rigid drum. The photosensitive member is preferably in the form of a flexible endless belt, a seamed belt or a sheet. As shown in FIGS. 4–7 and 9, the hold down mechanism comprises an adhesive applied between the drum and the photosensitive member, a slot in the drum and a clip, a magnetic, electrostatic or vacuum hold down mechanism.

Figure 2:
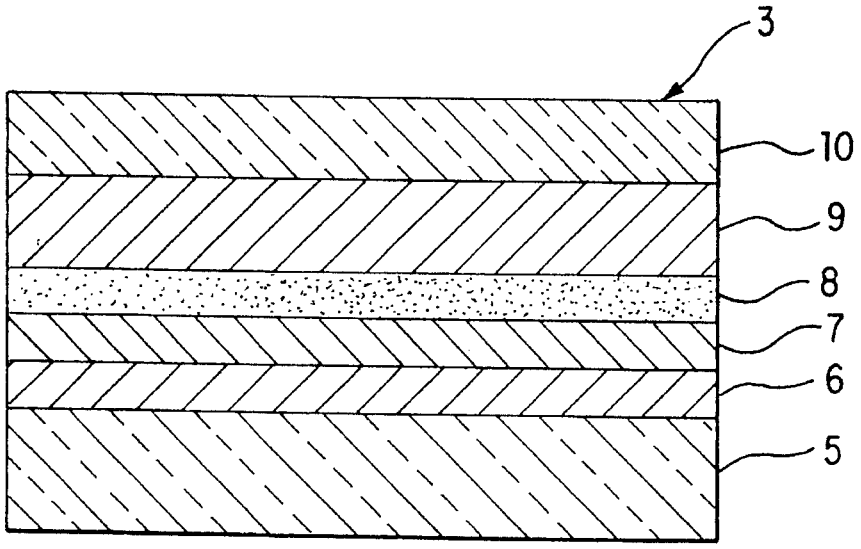
FIG. 2 is a cross-sectional view of the multi layers of a photosensitive member.

A representative configuration of a multilayered photosensitive member of the invention is shown in FIG. 2. The photosensitive member is a flexible imaging member provided with a supporting substrate 5, an electrically conductive ground plane 6, a charge blocking layer 7, an optional adhesive layer 8, a charge generating layer 9, and a charge transport layer 10. Other layers commonly used in electrophotographic imaging members may also be used, such as anti-curl layers, overcoating layers, and the like. Typical compositions of these layers are disclosed in Teuscher et al., U.S. Pat. No. 5,091,278, and Robinson et al., U.S. Pat. No. 5,164,276. The disclosure of these patents is incorporated herein by reference.

Various retainers and hold down mechanisms are shown in FIGS. 3–9. In FIG. 3, the photosensitive member 3 is in the form of a seamed belt or sheet. The photosensitive member 3 has two ends 13. Rotary drum 2 is in the form of a generally cylindrical shell. The shell has a slit 12 and a hinge 14 permitting expansion of the shell. The shell may be expanded via the mechanisms disclosed in U.S. Pat. No. 5,415,961 to Yu et al., incorporated herein by reference. The photosensitive member 3 is inserted into the slit and captured within the drum interior by a screw or a spring. The photosensitive member 3 is held down to the surface 15 of drum 2 by mechanically capturing ends 13 within the slit 12 of the drum 2. The slit 12 and the hinge 14 cooperate in the embodiment of FIG. 3 to form a retainer 11.

The structure of FIG. 4 comprises a magnetic device to form a retainer. FIG. 4 shows the electrophotographic imaging structure 1 including the rigid rotary drum 2 and the flexible photosensitive member 3. The photosensitive member 3 is shown peeled away from the surface of rotary drum 2 to expose the outer peripheral surface 4 of the drum 2. In the embodiment shown in FIG. 4, the retainer structure comprises magnetic strips 16 which are applied between the drum 2 and photo-sensitive member 3. The magnetic strips 16 secure photosensitive member 3 to the outer peripheral surface 4 of drum 2. Further by way of example, a magnetic retainer may be magnets located within the inside of the drum 2 in combination with a ferromagnetic material.

In FIG. 5, the photosensitive member 3 is shown peeled away from the surface 15 of the rotary drum 2 to show perforations 17 and ribs and slots 19. The perforations 17 extend through the structure of the drum 2, while the ribs and slots 19 extend across the substrate of the photosensitive member 3. Also shown in FIG. 5 is the vacuum hold down mechanism 18. The vacuum mechanism 18 within the drum comprises a battery powered pump attached to the drum interior, a pump powered by the centrifugal force of the rotating drum or a pump powered from the drum exterior via a shaft. The vacuum mechanism 18 comprises any suitable vacuum generating device.

In operation, the vacuum hold down mechanism 18 reduces pressure within the interior of rotary drum 2. The perforations 17 permit the reduced pressure in the interior of the rotary drum 2 to create an adhering force securing the photosensitive member 3 to the rotary drum 2. The ribs or slots 19 formed on the undersurface of photosensitive member 3 represent another embodiment of the invention. In this embodiment, the ribs and slot 19, in combination with the vacuum applied through perforations 17, cause the photosensitive member 3 to be more securely held to the rotary drum 2.

Figure 6:
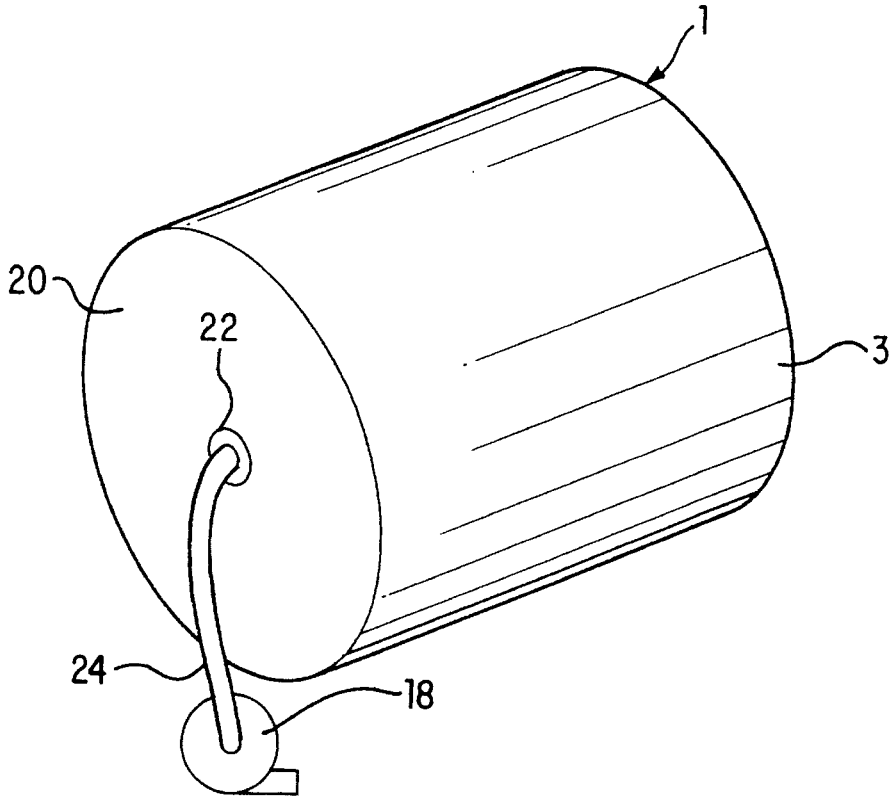

FIG. 5 shows an embodiment of the invention wherein pump 18 is located within the interior of the drum. FIG. 6 shows an embodiment of the invention wherein the pump 18 is locate outside of the drum 1. In this latter embodiment, the interior of the rotary drum 2 is sealed by a plate 20 at both ends of drum 1. The vacuum created by pump 18 is transferred via a pipe 21, through end plate 20. The pipe 21 is secured to the end plate 20 by means of a vacuum type seal 22.

Figure 7:
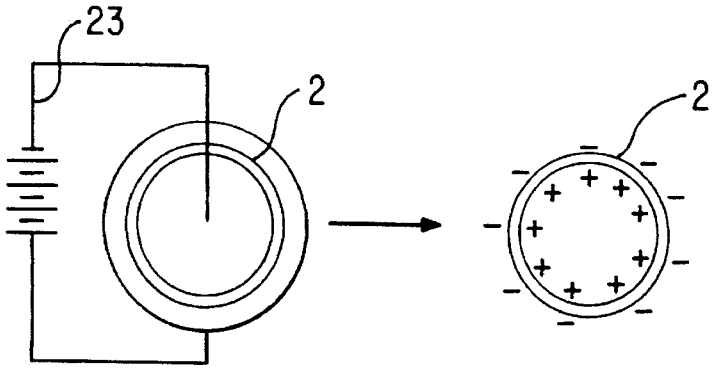
Figure 9:
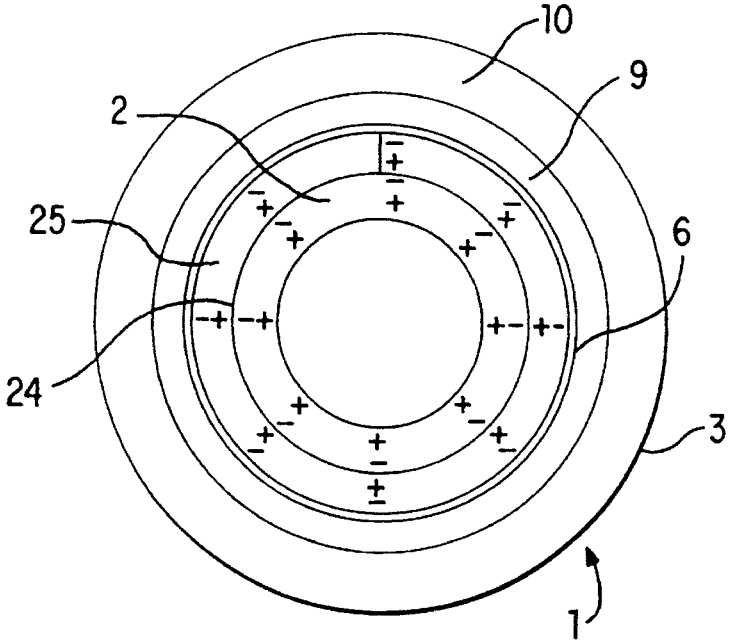
FIG. 9 shows a drum and photosensitive member structure with an electrostatic hold down mechanism.

FIGS. 7 and 9 show the electrophotographic imaging structure 1 comprising the drum 2 and the photosensitive member 3 and an electrostatic hold down mechanism generally illustrated in FIG. 9. The rotary drum 2 is an insulating cylinder or conductive drum coated with a discrete layer of insulating material. As shown, the insulating drum may be electrostatically charged. For example, FIG. 7 shows electrostatic charging of drum 2 via source 23. In the embodiments of FIGS. 7 and 9, a photosensitive member 3 in sheet form is preferred since sheets can be stored within a photoreceptor machine for easy replacement. The photoreceptor member 3 is provided with an insulating surface layer 25. The surface layer 25 is capable of supporting an electrostatic charge of opposite polarity to the charge residing on the drum 2. The insulating back surface layer 25 can be the same as the support substrate 5 of the photosensitive member 3 or can be a separate surface layer. The ground plane 6 of photosensitive member 3 functions to shield the charged interface between the insulating drum and insulating surface layer 25 from the influence of any electrostatic device used in xerographic processing steps.

Figure 8:
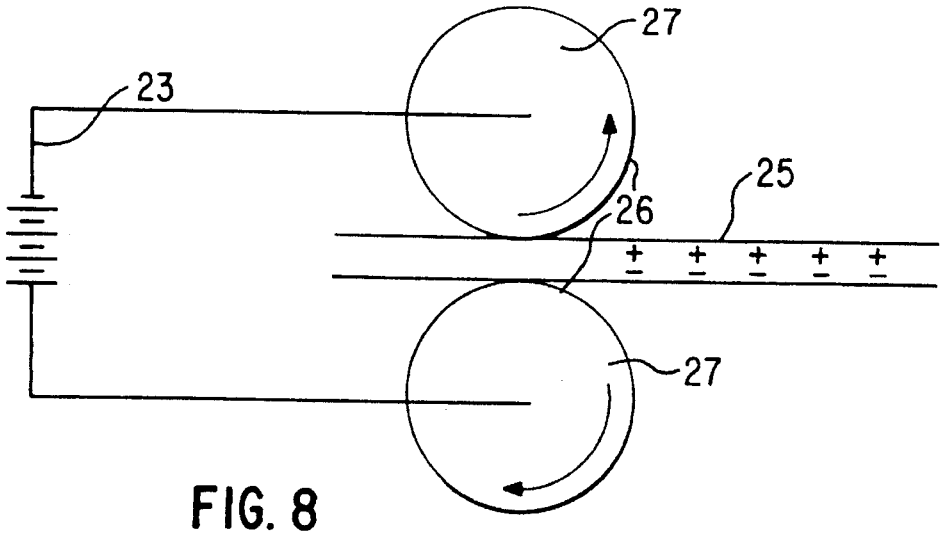
FIG. 8 shows a process for forming a surface layer of the photosensitive member as an electret.

In the embodiment shown in FIG. 8, electret technology may be applied to provide the electrostatic hold down mechanism. Electrets are permanently polarized dielectric materials. Electrets are formed by applying an electrical field to a material at a temperature above the glass transition temperature. The electret can attract an oppositely poled electret within its sphere of influence and cause that electret to strongly adhere. FIG. 8 shows a process for forming an electret. The electret substrate 25 shown in FIG. 8, is formed by drawing the substrate 25 through a nip 26 of a pair of hot rollers 27. The hot rollers 27 raise the temperature momentarily above the glass transition temperature $T_g$ of the substrate 25. Simultaneously, a high potential field is applied by means of a source 23. The high potential field is applied across the nip 26 as the substrate 25 is drawn through the hot rollers 27.

The electrophotographic imaging structure 1 shown in FIG. 9 includes the insulating drum structure 2 and photosensitive member 3 electrostatically held down to the surface 24 of drum 2. The photosensitive member 3 includes the surface layer 25 which is an electret. The surface layer 25 may be an additional layer that is applied as a substrate 5 to ground plane 6. FIG. 9 shows the photosensitive member 3 including the electret layer 25, the ground plane 6, the charge generating layer 9, and the charge transport layer 10.

The photosensitive imaging member 3 of this embodiment is produced by a process comprising the steps of providing an electret support substrate 25 and applying photosensitive layer onto the electret support substrate 25 to form the photosensitive member 3. Conductive layer 6 is a separate layer. A charge generating layer 9 is applied over the conductive layer 6 and a charge transport layer 10 is applied over the charge generating layer 9.

While the invention has been described with reference to particular preferred embodiments, the invention is not limited to the specific examples given. For example, the embodiments described in FIGS. 7 to 9 relate to an electrostatic hold down mechanism through electret interaction. However, the electrostatic effect can be generated by corona charging or by any other means. Further, the electrostatographic imaging structure could comprise an electrographic imaging structure and the imaging member could comprise an ionographic imaging member. Other embodiments and modifications, including for example other electrostatic imaging structures, can be made by those skilled in the art without the departing from spirit and scope of the invention and claims.

What is claimed is:

1. An electrostatographic imaging structure comprising a rotary drum having an outer peripheral surface defining a circumferential surface of said drum, a retainer and a photosensitive member in the form of a sheet wrapped completely around the circumferential surface of said drum and held down to said outer peripheral surface of said drum by mechanical capture of ends of said sheet by said retainer.

2. The electrostatographic imaging structure of claim 1, comprising an electrostatographic imaging structure.

3. The electrostatographic imaging structure of claim 2, comprising a rigid rotary drum and a flexible photosensitive member.

4. The structure of claim 1, wherein said photosensitive member comprises a conductive layer, a charge generating layer and a charge transport layer.

5. The structure of claim 1, wherein said photosensitive member has two ends and at least one end is held down to said surface of said drum by said retainer at a single spot location on said outer peripheral surface.

6. The structure of claim 1, wherein said retainer is a mechanical structure capturing said ends of said sheet.

7. The structure of claim 6, wherein said drum comprises a generally cylindrical shaped shell and said retainer comprises a portion of said shell having opposing ends and a slit between the ends permitting expansion of said shell.

8. An electrostatographic imaging structure comprising a rotary drum having an outer peripheral surface defining a circumferential surface of said drum, a retainer and a photosensitive member wrapped completely around the circumferential surface of said drum and held down to said outer peripheral surface of said drum by said retainer, wherein (i) said retainer is a mechanical structure comprising a portion of said shell having opposing ends and a slit between the ends to permit expansion of said shell, and (ii) said photosensitive member has two ends and is held down by capture of at least one end within the slit of said retainer.

9. The structure of claim 8, wherein said retainer comprises an adhesive applied between said drum and said photosensitive member to further hold down said member.

10. The structure of claim 8, wherein said drum has an adjustable external circumference and further comprises an adjuster for changing said circumference of said rotary drum.

11. An electrostatographic imaging structure comprising a rotary drum having an outer peripheral surface defining a circumferential surface of said drum, a retainer and a photosensitive member wrapped completely around the circumferential surface of said drum and held down to said outer peripheral surface of said drum by said retainer, wherein said retainer comprises an adhesive applied between said drum and said photosensitive member to hold down said member.

12. The structure of claim 11, wherein said photosensitive member comprises an endless belt.

13. The structure of claim 11, wherein said photosensitive member comprises a seamed belt.

14. The structure of claim 11, wherein said photosensitive member comprises a sheet.

15. An electrostatographic imaging structure comprising a rotary drum having an outer peripheral surface defining a circumferential surface of said drum, a retainer and a photosensitive member wrapped completely around the circumferential surface of said drum and held down to said outer peripheral surface of said drum by said retainer, wherein said retainer comprises a magnetic device within said drum.

16. An electrostatographic imaging structure comprising a rotary drum having an outer peripheral surface defining a circumferential surface of said drum, a retainer and a photosensitive member wrapped completely around the circumferential surface of said drum and held down to said outer peripheral surface of said drum by said retainer, wherein said retainer comprises a magnetic hold down mechanism between said drum and said photosensitive member to hold down said member.

17. The structure of claim 16, wherein said magnetic down mechanism comprises magnetic strips applied between said drum and said photosensitive member.

18. The structure of claim 16, wherein said drum comprises a generally cylindrical shaped shell and said retainer comprises a portion of said shell having opposing ends and a slit between the ends permitting expansion of said shell.

19. The structure of claim 18, wherein said photosensitive member is held down by mechanical capture of at least one end of said member within the slit of said retainer.

20. The structure of claim 19, wherein said drum is characterized by an adjustable external circumference and further comprises an adjuster for changing said circumference of said rotary drum.

21. An electrostatographic imaging structure comprising a rotary drum having an outer peripheral surface defining a circumferential surface of said drum, a retainer and a photosensitive member wrapped completely around the circumferential surface of said drum and held down to said outer peripheral surface of said drum by said retainer, wherein said drum comprises apertures through said outer peripheral surface between an interior of said drum and said photosensitive member and said retainer comprises a vacuum hold down mechanism within said drum to hold down said photosensitive member.

22. The structure of claim 21, wherein said apertures comprise an array of perforations evenly or unevenly distributed over said drum outer peripheral surface.

23. The structure of claim 22 wherein said perforations have a diameter between 0.001 to 0.1 mils.

24. The structure of claim 23 wherein said perforations have a diameter between 0.020 to 0.050 mils.

25. The structure of claim 24, wherein density of said perforations over said drum outer peripheral surface is between 0.3% to 50% of surface area of said drum surface.

26. The structure of claim 24, wherein density of said perforations over said drum outer peripheral surface is between 5% to 10% of surface area of said drum surface.

27. The structure of claim 24, wherein said perforations are a product of fabrication into said drum outer peripheral surface by laser drilling.

28. The structure of claim 24, wherein said drum comprises one of nickel and a nickel alloy and said perforations are a product of fabrication into said drum outer peripheral surface by electroforming.

29. The structure of claim 21, wherein said photosensitive member comprises a substrate with an array of ribs and slots oriented parallel to a longitudinal axis of the drum and extending across a width of said member.

30. The structure of claim 21, wherein said apertures comprise a microscopically porous surface formed as at least part of said peripheral surface of said drum.

31. The structure of claim 21, wherein said vacuum hold down mechanism comprises a vacuum pump external to said drum, a pipe between said pump and an interior of said drum, said interior defined by a vacuum tight seal around said pipe.

32. The structure of claim 21, wherein said vacuum hold down mechanism comprises a vacuum pump located within an interior of said drum.

33. The structure of claim 21, wherein said retainer comprises an adhesive applied between said drum and said photosensitive member to further hold down said member.

34. The structure of claim 21, wherein said retainer comprises a mechanical attachment of the member at an edge.

35. An electrophotographic imaging structure comprising a rotary drum having an outer peripheral surface defining a circumferential surface of said drum, a photosensitive member and a hold down mechanism between said drum and said photosensitive member holding down said member wrapped completely around the circumferential surface of said drum.

36. An electrophotographic imaging structure comprising a rotary drum having an outer peripheral surface defining a circumferential surface of said drum, a photosensitive member and a hold down mechanism between said drum and said photosensitive member holding down said member wrapped completely around the circumferential surface of said drum, wherein said hold down mechanism is an electrostatic hold down mechanism.

37. The structure of claim 36, wherein said rotary drum includes a generally cylindrical-shaped shell having opposing ends and a slit between the ends permitting expansion of said shell.

38. The structure of claim 37, wherein said photosensitive member is further held down by mechanical capture of at least one end of said member within the slit of said rotary drum.

39. The structure of claim 38, wherein said drum has an adjustable external circumference and further comprises an adjuster for changing said circumference of said rotary drum.

40. The structure of claim 36, wherein said electrostatic hold down mechanism comprises an electrostatically charged insulative layer of a first polarity on said peripheral surface of the rotating drum and said photosensitive member comprises an electrostatically charged insulative surface of opposite polarity to the first polarity.

41. The structure of claim 40, wherein said photosensitive member comprises a ground plane.

42. The structure of claim 40, wherein said insulative layer is an electret.

43. An electrophotographic imaging structure comprising a rotary drum having an outer peripheral surface defining a circumferential surface of said drum, a photosensitive member and a hold down mechanism between said drum and said photosensitive member holding down said member wrapped completely around the circumferential surface of said drum, wherein said rotary drum comprises a ferromagnetic material to provide at least part of said hold down mechanism as at least part of said rotary drum.

44. The structure of claim 43, wherein said photosensitive member comprises a ferromagnetic material to provide at least part of said hold down mechanism as at least part of said member.

45. An image forming process utilizing an electrophotographic imaging structure having at least one distinctive outer layer comprising a rotary drum having an outer peripheral surface, a vacuum hold down mechanism either separate from or a part of said drum and a photosensitive member held down to said peripheral surface of said drum by said vacuum hold down mechanism, said process comprising (i) developing a vacuum by powering up said hold down mechanism to hold down said photosensitive member to the peripheral surface of said drum, (ii) conducting cycles of image formation comprising forming latent images on said photosensitive member, developing the image by means of a developer and transferring said image onto a transfer material, and (iii) maintaining a reduced vacuum by said hold down mechanism to hold down said photosensitive member after conducting said cycles of image formation.

46. A process for preparing an electrophotographic imaging structure, comprising providing an electret support, applying a photosensitive layer onto said electret support to form a photosensitive member and mounting said photosensitive member onto a peripheral surface of a rotary drum.

47. The process of claim 46, comprising applying a conductive layer over said electret support.

48. The process of claim 47, comprising applying a charge generator layer over said conductive layer and applying a charge transport layer over said charge generator layer.

49. A process for preparing an electrophotographic imaging structure, comprising providing an electret support and applying a photosensitive layer onto said electret support to form a photosensitive member, wherein said electret support comprises an insulating material and wherein said providing step comprises applying an electrical field to the insulating material at a temperature above a glass transition temperature of said material.

* * * * *